US011257348B1

(12) United States Patent
Hughes

(10) Patent No.: US 11,257,348 B1
(45) Date of Patent: Feb. 22, 2022

(54) SAFETY ALERT SYSTEM

(71) Applicant: Cathy Hughes, Eubank, KY (US)

(72) Inventor: Cathy Hughes, Eubank, KY (US)

( * ) Notice: Subject to any disclaimer, the term of this patent is extended or adjusted under 35 U.S.C. 154(b) by 0 days.

(21) Appl. No.: 16/299,852

(22) Filed: Mar. 12, 2019

(51) Int. Cl.

| | |
|---|---|
| ***G08B 1/08*** | (2006.01) |
| ***G08B 21/24*** | (2006.01) |
| ***G08B 3/10*** | (2006.01) |
| *G08B 21/22* | (2006.01) |
| *G08B 21/02* | (2006.01) |

(52) U.S. Cl.
CPC ..... *G08B 21/24* (2013.01); *G08B 3/10* (2013.01); *G08B 21/0202* (2013.01); *G08B 21/22* (2013.01)

(58) Field of Classification Search
CPC ..... G08B 21/24; G08B 21/0202; G08B 21/0205; G08B 21/0258; G01B 21/22; B60R 21/01556; B60N 2/26
See application file for complete search history.

(56) References Cited

U.S. PATENT DOCUMENTS

| | | | | |
|---|---|---|---|---|
| 6,535,137 | B1 | 3/2003 | Ryan | |
| 6,922,147 | B1 | 7/2005 | Viksnins | |
| 7,009,522 | B2 | 3/2006 | Flanagan | |
| 7,106,207 | B1 | 9/2006 | Marchan | |
| 8,058,983 | B1 * | 11/2011 | Davisson | G08B 21/0205 340/10.1 |
| D650,715 | S | 12/2011 | Hill | |
| 8,768,292 | B2 | 7/2014 | Welch | |
| 9,030,313 | B1 | 5/2015 | Pearson | |
| 9,139,128 | B1 | 9/2015 | Lemons | |
| 9,569,948 | B1 | 2/2017 | Platt | |
| 9,854,385 | B2 * | 12/2017 | Oliver | G08B 13/1427 |
| 2006/0261958 | A1 * | 11/2006 | Klein | A01K 11/006 340/572.8 |
| 2011/0241867 | A1 | 10/2011 | Neal | |
| 2016/0196732 | A1 * | 7/2016 | Jones | B60Q 9/00 340/686.6 |

FOREIGN PATENT DOCUMENTS

| | | |
|---|---|---|
| WO | WO2012109472 | 8/2012 |

* cited by examiner

*Primary Examiner* — Toan N Pham

(57) ABSTRACT

A safety alert system for alerting a user to a person, animal, or article unintentionally left in a vehicle includes an alert module that is configured to couple to an ignition key of a vehicle and sensing module that is configured to selectively couple to a person, animal, and article that is positioned in the vehicle. The alert module comprises a first transceiver, a first proximity sensor, and a first speaker. The sensing module comprises a second transceiver and a second proximity sensor, which is operationally coupled to the first proximity sensor so that a separation between the sensing module and the alert module is measurable. The second transceiver signals the first transceiver in event the separation exceeds a predefined distance, positioning the alert module to broadcast an alarm via the first speaker to alert the user that the person, animal, or article still is positioned in the vehicle.

9 Claims, 4 Drawing Sheets

SAFETY ALERT SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to alert systems and more particularly pertains to a new alert system for alerting a user to a person, animal, or article unintentionally left in a vehicle.

BRIEF SUMMARY OF THE INVENTION

An embodiment of the disclosure meets the needs presented above by generally comprising an alert module that is configured to couple to an ignition key of a vehicle and sensing module that is configured to selectively couple to a person, animal, and article that is positioned in the vehicle. The alert module comprises a first transceiver, a first proximity sensor, and a first speaker. The sensing module comprises a second transceiver and a second proximity sensor, which is operationally coupled to the first proximity sensor so that a separation between the sensing module and the alert module is measurable. The second transceiver signals the first transceiver in event the separation exceeds a predefined distance, positioning the alert module to broadcast an alarm via the first speaker to alert a user that the person, animal, or article still is positioned in the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
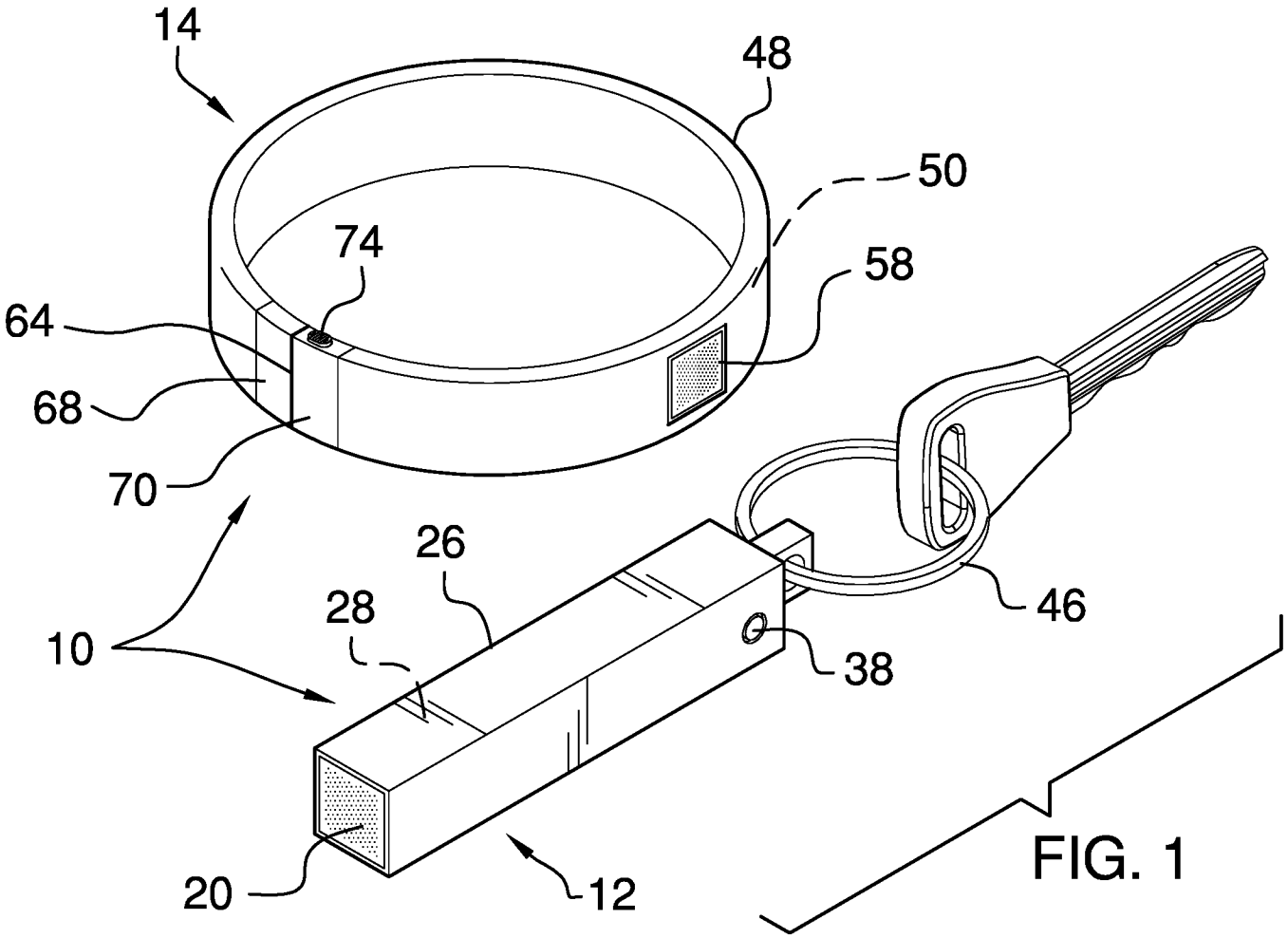
FIG. 1 is an isometric perspective view of a safety alert system according to an embodiment of the disclosure.

With reference now to the drawings, and in particular to FIGS. 1 through 5 thereof, a new alert system embodying the principles and concepts of an embodiment of the disclosure and generally designated by the reference numeral 10 will be described.

As best illustrated in FIGS. 1 through 5, the safety alert system 10 generally comprises an alert module 12 and a sensing module 14. The alert module 12 comprises a first transceiver 16, a first proximity sensor 18, and a first speaker 20 and is configured to couple to an ignition key of a vehicle, as shown in FIG. 1.

The sensing module 14 comprises a second transceiver 22 and a second proximity sensor 24, which is operationally coupled to the first proximity sensor 18 so that a separation between the sensing module 14 and the alert module 12 is measurable. The sensing module 14 is configured to selectively couple to a person, animal, and article that is positioned in the vehicle. The second transceiver 22 is configured to signal the first transceiver 16, in an event the separation between the sensing module 14 and the alert module 12 exceeds a predefined distance, positioning the alert module 12 to broadcast an alarm via the first speaker 20 to alert a user that the person, animal, or article still is positioned in the vehicle. The system 10 has potential to prevent injury and death to the person or animal as it alerts the user to the fact that the person or animal still is in the vehicle. The system 10 also has potential to prevent theft of a valuable article due to forgetting the valuable article in the vehicle, and in preventing damage to an article that is susceptible to damage by high temperatures.

Proximity sensors are well known to those skilled in the art of sensors. The present invention anticipates the first proximity sensor 18 and the second proximity sensor 24 comprising any combination of sensors that allows the determination of the separation between the sensing module 14 and the alert module 12. The predefined distance may be set to 15 feet.

Figure 2:
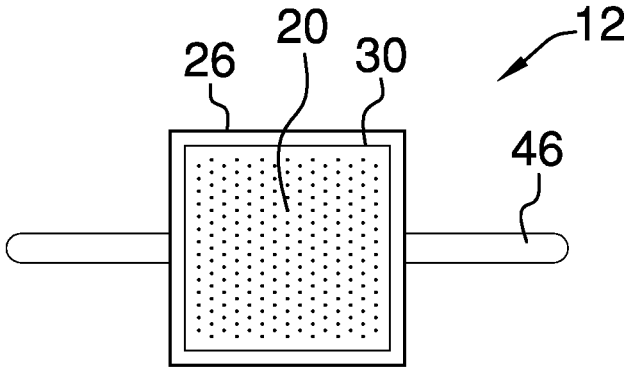
FIG. 2 is an end view of an embodiment of the disclosure.
Figure 3:
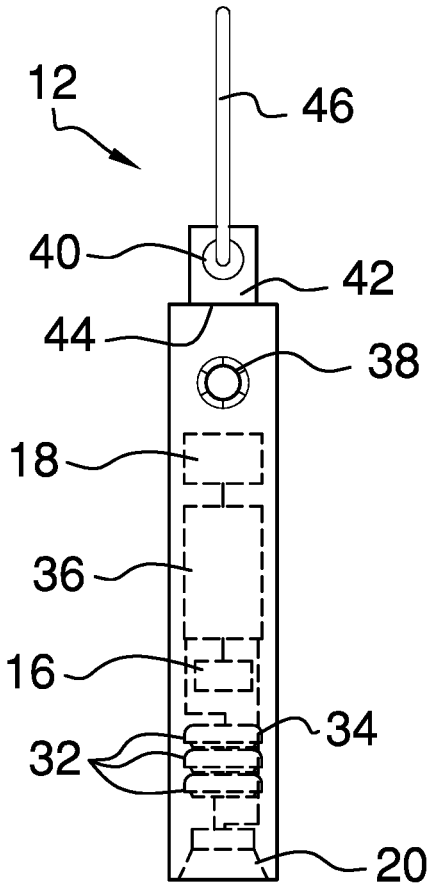
FIG. 3 is a side view of an embodiment of the disclosure.
Figure 4:
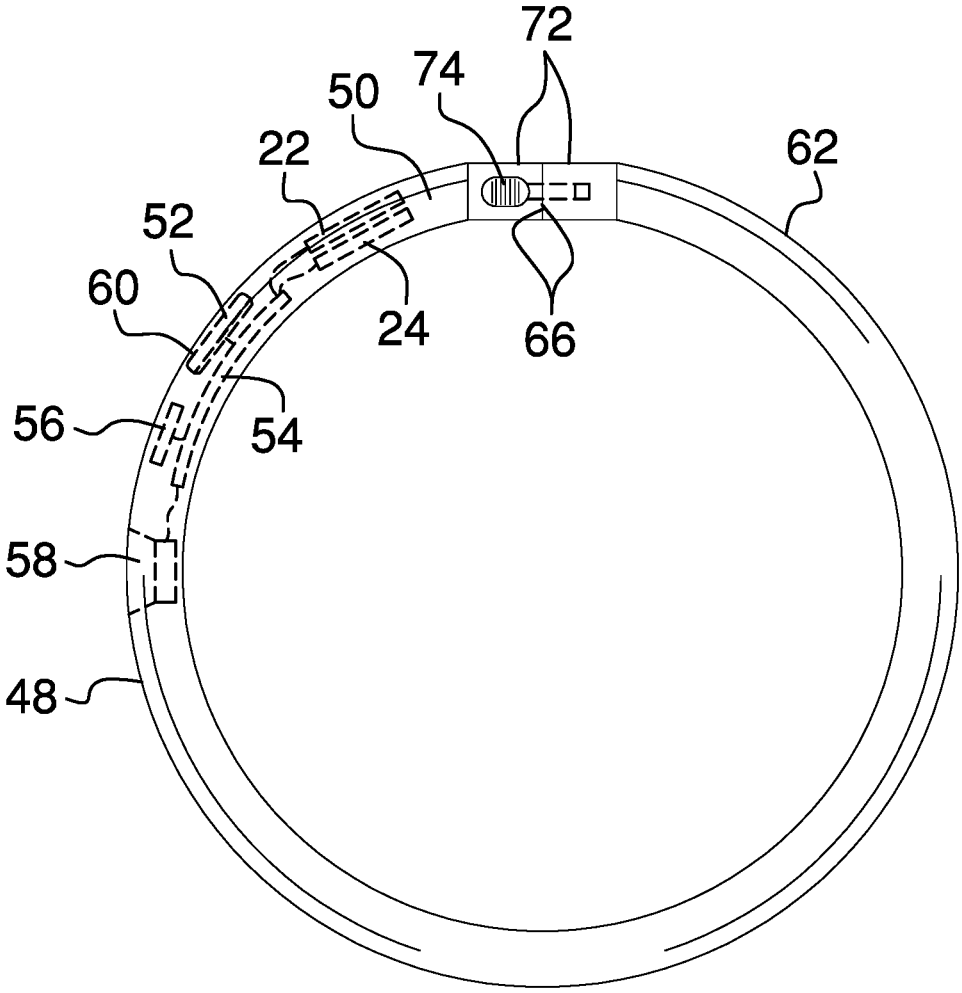
FIG. 4 is a side view of an embodiment of the disclosure.

The alert module 12 comprises a first housing 26 that defines an interior space 28. The first transceiver 16 and the first proximity sensor 18 are coupled to the first housing 26 and are positioned in the interior space 28. The first speaker 20 is coupled to a first end 30 of the first housing 26, as shown in FIG. 2. The first housing 26 is substantially rectangularly box shaped.

A first power module 32, which comprises a first battery 34, and a first microprocessor 36 are coupled to the first housing 26 and are positioned in the interior space 28. The first microprocessor 36 is operationally coupled to the first power module 32, the first transceiver 16, the first proximity sensor 18, and the first speaker 20.

A reset button 38, which is depressible, is coupled to the first housing 26 and is operationally coupled to the first microprocessor 36. The reset button 38 is configured to be selectively depressed to signal the first microprocessor 36 to terminate the alarm.

A hole 40 is positioned in a tab 42 that is coupled to and extends from a second end 44 of the first housing 26. A keyring 46 is positioned through the hole 40 so that the keyring 46 is coupled to the first housing 26. The keyring 46 is configured to couple to the ignition key of the vehicle to couple the first housing 26 to the ignition key.

The sensing module 14 comprises a second housing 48 that defines an internal space 50. The second transceiver 22, the second proximity sensor 24, a second power module 52, a second microprocessor 54, and a temperature sensor 56 are coupled to the second housing 48 and are positioned in the internal space 50. A second speaker 58 is coupled to the second housing 48. The second power module 52 comprises a second battery 60. The second microprocessor 54 is operationally coupled to the second power module 52, the second transceiver 22, the second proximity sensor 24, the temperature sensor 56, and the second speaker 58.

Figure 5:
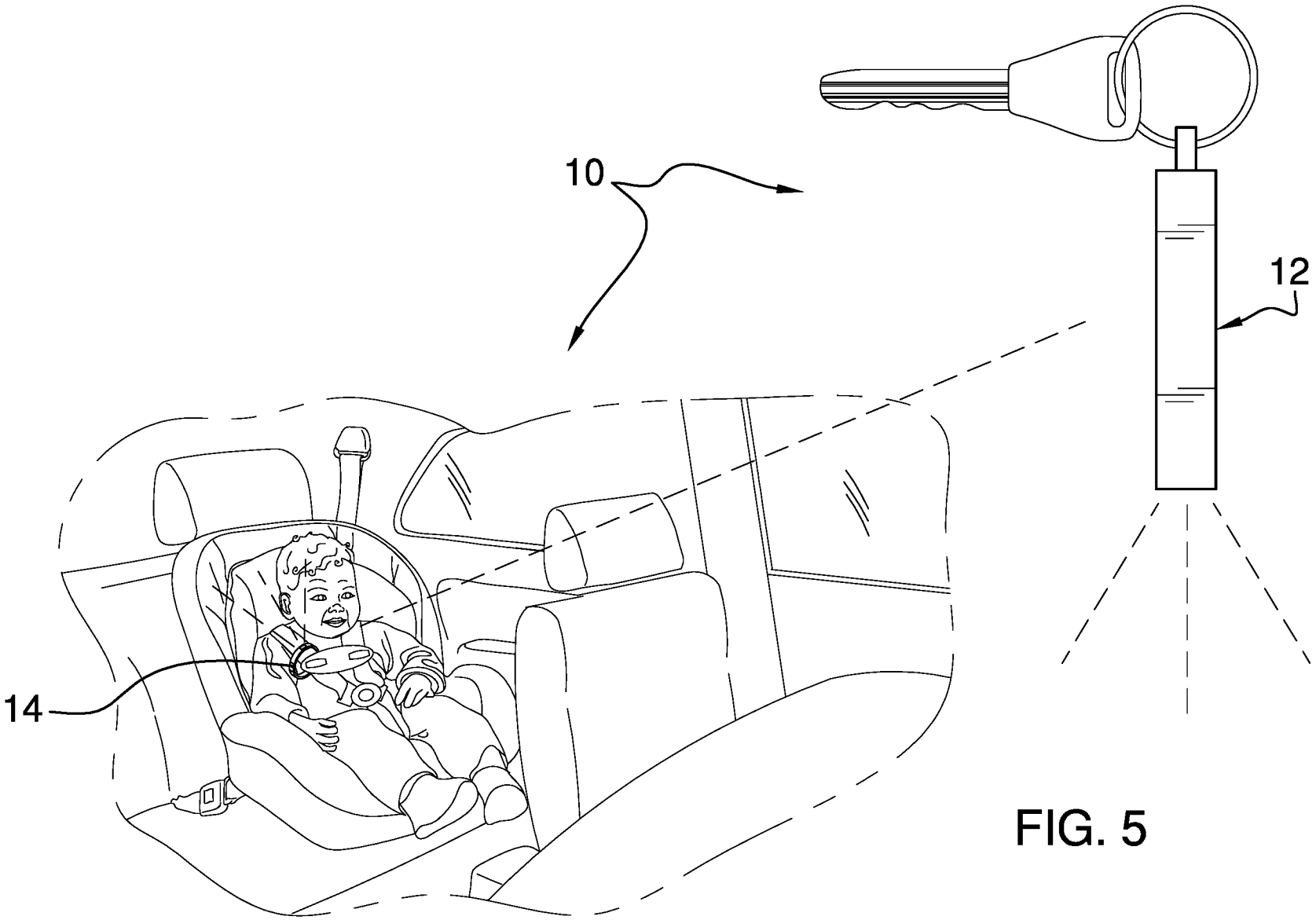
FIG. 5 is an in-use view of an embodiment of the disclosure.

The second microprocessor 54 is positioned to receive a separation dependent input from the second proximity sensor 24 to determine the separation between the sensing module 14 and the alert module 12. The second microprocessor 54 then is positioned, in the event the separation between the sensing module 14 and the alert module 12 exceeds the predefined distance, to command the second transceiver 22 to signal the first microprocessor 36, via the first transceiver 16, to command the first speaker 20 to broadcast the alarm to alert the user that the person, animal, or article still is positioned in the vehicle, as shown in FIG. 5.

The temperature sensor 56 is configured to measure a temperature within the vehicle and to relay a temperature reading to the second microprocessor 54. The second microprocessor 54 then is positioned to actuate the second speaker 58, in event the temperature reading exceeds a preset temperature, to alert an individual proximate to the vehicle that the person, animal, or article that is positioned in the vehicle is subject to an unsafe temperature. The combination of the temperature sensor 56 and the second speaker 58 enables the system 10 to alert the individual proximate to the vehicle so that the individual can intervene, in the absence of the user, to prevent injury and death to the person or animal that is in the vehicle. The preset temperature may be set to 90 degrees Fahrenheit.

The second housing 48 may be configured as a bracelet 62, as shown in FIG. 1. A slit 64 is positioned in the bracelet 62 to define opposing ends 66 of the bracelet 62. The bracelet 62 comprises at least one of rubber, silicone and plastic so that the bracelet 62 is resiliently flexible, wherein the opposing ends 66 are reversibly separable to position the bracelet 62 around a respective element of the person, animal, or article that is positioned in the vehicle. For example, the bracelet 62 may be positioned around a strap of a child safety seat, a collar attached to a pet, or a wrist of the person.

A first coupler 68 and a second coupler 70 are coupled singly to the opposing ends 66 of the bracelet 62. The second coupler 70 is complementary to the first coupler 68 so that the second coupler 70 is positioned to selectively couple to the first coupler 68 to secure the bracelet 62 to the respective element of the person, animal, and article that is positioned in the vehicle.

The first coupler 68 and the second coupler 70 comprise a clasp 72. A clasp button 74 is coupled to the bracelet 62 proximate to a respective opposing end 66. The clasp button 74 is depressible and is operationally coupled to the clasp 74. The clasp button 74 is configured to be selectively depressed to unlock the bracelet 62.

In use, the alert module 12 is coupled to ignition key of a vehicle using the keyring 46. The sensing module 14 is coupled to the person, animal, or article that is positioned in the vehicle. When the separation between the sensing module 14 and the alert module 12 exceeds the predefined distance, the alert module 12 broadcasts the alarm via the first speaker 20 to alert the user that the person, animal, or article still is positioned in the vehicle, allowing the user to rectify the situation.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A safety alert system comprising:

an alert module comprising a first transceiver, a first proximity sensor, and a first speaker, the alert module being configured for coupling to an ignition key of a vehicle;

a sensing module comprising a second transceiver and a second proximity sensor, the second proximity sensor being operationally coupled to the first proximity sensor such that a separation between the sensing module and the alert module is measurable, the sensing module being configured for selectively coupling to a person, animal, and article positioned in the vehicle wherein the second transceiver is configured for signaling the first transceiver in event the separation between the sensing module and the alert module exceeds a predefined distance positioning the alert module for broadcasting an alarm via the first speaker for alerting a user that the person, animal, or article still is positioned in the vehicle;

the alert module comprising:

a first housing defining an interior space, the first transceiver and the first proximity sensor being coupled to the first housing and positioned in the interior space, the first speaker being coupled to a first end of the first housing, a first power module coupled to the first housing and positioned in the interior space, and a first microprocessor coupled to the first housing and positioned in the interior space, the first microprocessor being operationally coupled to the first power module, the first transceiver, the first proximity sensor, and the first speaker; and the sensing module comprising:

a second housing defining an internal space, the second transceiver and the second proximity sensor being coupled to the second housing and positioned in the internal space, the second housing being configured as a bracelet, a second power module coupled to the second housing and positioned in the internal space, a second microprocessor coupled to the second housing and positioned in the internal space, the second microprocessor being operationally coupled to the second power module, the second transceiver, and the second proximity sensor wherein the second microprocessor is positioned for receiving a separation dependent input from the second proximity sensor for determining the separation between the sensing module and the alert module positioning the second microprocessor, in the event the separation between the sensing module and the alert module exceeds the predefined distance, for commanding the second transceiver for signaling the first microprocessor, via the first transceiver, for commanding the first speaker for broadcasting the alarm for alerting the user that the person, animal, or article still is positioned in the vehicle, a second speaker coupled to the second housing the second speaker being operationally coupled to the second microprocessor, and a temperature sensor coupled to the second housing and positioned in the internal space the temperature sensor being operationally coupled to the second microprocessor wherein the temperature sensor is configured for measuring a temperature within the vehicle and for relaying a temperature reading to the second microprocessor positioning the second microprocessor for actuating the second speaker, in event the temperature reading exceeds a preset temperature, for alerting an individual proximate to the vehicle that the person, animal, or article positioned in the vehicle is subject to an unsafe temperature.

2. The system of claim 1, further including comprising:

a tab coupled to and extending from a second end of the first housing;

a hole positioned in the tab; and a keyring positioned through the hole such that the keyring is couple to the first housing wherein the keyring is configured for coupling to the ignition key of the vehicle for coupling the first housing to the ignition key.

3. The system of claim 1, further including the first housing being substantially rectangularly box shaped.

4. The system of claim 1, further comprising:

the first power module comprising a first battery; and the second power module comprising a second battery.

5. The system of claim 1, further including a slit positioned in the bracelet defining opposing ends of the bracelet, the bracelet comprising at least one of rubber, silicone and plastic such that the bracelet is resiliently flexible wherein the opposing ends are reversibly separable for positioning the bracelet around a respective element of the person, animal, and article positioned in the vehicle.

6. The system of claim 5, further including a first coupler and a second coupler coupled singly to the opposing ends, the second coupler being complementary to the first coupler wherein the second coupler is positioned for selectively coupling to the first coupler for securing the bracelet to the respective element of the person, animal, and article positioned in the vehicle.

7. The system of claim 6, further comprising:

the first coupler and the second coupler comprising a clasp; and a clasp button coupled to the bracelet proximate to a respective opposing end, the clasp button being depressible, the clasp button being operationally coupled to the clasp wherein the clasp button is configured for being selectively depressed for unlocking the bracelet.

8. The system of claim 1, further including a reset button coupled to the first housing, the reset button being depressible, the reset button being operationally coupled to the first microprocessor wherein the reset button is configured for being selectively depressed for signaling the first microprocessor for terminating the alarm.

9. A safety alert system comprising:

an alert module comprising a first transceiver, a first proximity sensor, and a first speaker, the alert module being configured for coupling to an ignition key of a vehicle, the alert module comprising:

a first housing defining an interior space, the first transceiver and the first proximity sensor being coupled to the first housing and positioned in the interior space, the first speaker being coupled to a first end of the first housing, the first housing being substantially rectangularly box shaped, a first power module coupled to the first housing and positioned in the interior space, the first power module comprising a first battery, and a first microprocessor coupled to the first housing and positioned in the interior space, the first microprocessor being operationally coupled to the first power module, the first transceiver, the first proximity sensor, and the first speaker;

a tab coupled to and extending from a second end of the first housing;

a hole positioned in the tab;

a keyring positioned through the hole such that the keyring is coupled to the first housing wherein the keyring is configured for coupling to the ignition key of the vehicle for coupling the first housing to the ignition key;

a sensing module comprising a second transceiver and a second proximity sensor, the second proximity sensor being operationally coupled to the first proximity sensor such that a separation between the sensing module and the alert module is measurable, the sensing module being configured for selectively coupling to a person, animal, and article positioned in the vehicle wherein the second transceiver is configured for signaling the first transceiver in event the separation between the sensing module and the alert module exceeds a predefined distance positioning the alert module for broadcasting an alarm via the first speaker for alerting a user that the person, animal, or article still is positioned in the vehicle, the sensing module comprising:

a second housing defining an internal space, the second transceiver and the second proximity sensor being coupled to the second housing and positioned in the internal space, the second housing being configured as a bracelet, a slit positioned in the bracelet defining opposing ends of the bracelet, the bracelet comprising at least one of rubber, silicone and plastic such that the bracelet is resiliently flexible wherein the opposing ends are reversibly separable for positioning the bracelet around a respective element, of the person, animal, and article positioned in the vehicle, a first coupler and a second coupler coupled singly to the opposing ends, the second coupler being complementary to the first coupler wherein the second coupler is positioned for selectively coupling to the first coupler for securing the bracelet to the respective element of the person, animal, and article positioned in the vehicle, the first coupler and the second coupler comprising a clasp, a clasp button coupled to the bracelet proximate to a respective opposing end, the clasp button being depressible, the clasp button being operationally coupled to the clasp wherein the clasp button is configured for being selectively depressed for unlocking the bracelet, a second power module coupled to the second housing and positioned in the internal space, the second power module comprising a second battery, a second microprocessor coupled to the second housing and positioned in the internal space, the second microprocessor being operationally coupled to the second power module, the second transceiver, and the second proximity sensor wherein the second microprocessor is positioned for receiving a separation dependent input from the second proximity sensor for determining the separation between the sensing module and the alert module positioning the second microprocessor, in the event the separation between the sensing module and the alert module exceeds the predefined distance, for commanding the second transceiver for signaling the first microprocessor, via the first transceiver, for commanding the first speaker for broadcasting the alarm for alerting the user that the person, animal, or article still is positioned in the vehicle, a second speaker coupled to the second housing, the second speaker being operationally coupled to the second microprocessor, and a temperature sensor coupled to the second housing and positioned in the internal space, the temperature sensor being operationally coupled to the second microprocessor wherein the temperature sensor is configured for measuring a temperature within the vehicle and for relaying a temperature reading to the second microprocessor positioning the second microprocessor for actuating the second speaker, in event the temperature reading exceeds a preset temperature, for alerting an individual proximate to the vehicle that the person, animal, or article positioned in the vehicle is subject to an unsafe temperature; and a reset button coupled to the first housing, the reset button being depressible, the reset button being operationally coupled to the first microprocessor wherein the reset button is configured for being selectively depressed for signaling the first microprocessor for terminating the alarm.

* * * * *